US008360935B2

(12) United States Patent
Olsen et al.

(10) Patent No.: US 8,360,935 B2
(45) Date of Patent: Jan. 29, 2013

(54) METHOD, A COMPUTER PROGRAM, AND DEVICE FOR CONTROLLING A MOVABLE RESISTANCE ELEMENT IN A TRAINING DEVICE

(75) Inventors: Ole Olsen, Stathelle (NO); Rolf Öhman, Västerås (SE)

(73) Assignee: Sensyact AB, Västerås (SE)

( * ) Notice: Subject to any disclaimer, the term of this patent is extended or adjusted under 35 U.S.C. 154(b) by 820 days.

(21) Appl. No.: 12/083,554

(22) PCT Filed: Oct. 12, 2006

(86) PCT No.: PCT/SE2006/050397

§ 371 (c)(1),
(2), (4) Date: Sep. 1, 2009

(87) PCT Pub. No.: WO2007/043970

PCT Pub. Date: Apr. 19, 2007

(65) Prior Publication Data

US 2010/0069202 A1 Mar. 18, 2010

(30) Foreign Application Priority Data

Oct. 12, 2005 (SE) ..... 0502268

(51) Int. Cl.
*A63B 71/00* (2006.01)

(52) U.S. Cl. ..... 482/5; 482/1; 482/8; 482/901

(58) Field of Classification Search ..... 482/1–9, 482/900–902; 434/247, 254
See application file for complete search history.

(56) References Cited

U.S. PATENT DOCUMENTS

| | | | | |
|---|---|---|---|---|
| 4,919,418 | A | 4/1990 | Miller | |
| 4,930,770 | A | 6/1990 | Baker | |
| 5,117,170 | A | 5/1992 | Keane et al. | |
| 5,919,115 | A | 7/1999 | Horowitz et al. | |
| 6,231,481 | B1 | 5/2001 | Brock | |
| 6,942,603 | B1 * | 9/2005 | Tsai et al. | 482/57 |
| 8,052,584 | B2 * | 11/2011 | Keiser | 482/100 |
| 2011/0251021 | A1 * | 10/2011 | Zavadsky et al. | 482/5 |

OTHER PUBLICATIONS

PCT/ISA/210—International Search Report—Jan. 22, 2007.
PCT/ISA/237—Written Opinion of the International Searching Authority—Jan. 22, 2007.

* cited by examiner

*Primary Examiner* — Glenn Richman
(74) *Attorney, Agent, or Firm* — Venable LLP; Eric J. Franklin

(57) ABSTRACT

A method for controlling a movable resistance element belonging to a training device. The resistance element is influenced by a user with a muscular force. A device is adapted to generate a reference signal for controlling a power conversion device coupled to and controlling a movable resistance element belonging to a training device, and which is influenced by a user with a muscular force. A computer program for carrying out the method and a use of the device.

13 Claims, 3 Drawing Sheets

METHOD, A COMPUTER PROGRAM, AND DEVICE FOR CONTROLLING A MOVABLE RESISTANCE ELEMENT IN A TRAINING DEVICE

CROSS-REFERENCE TO RELATED APPLICATIONS

This application claims priority to Swedish patent application 0502268-6 filed 12 Oct. 2005.

TECHNICAL FIELD

The present invention relates to a method for controlling a movable resistance element of a training device, when a user influences the resistance element with a muscular force during exercise. The invention also relates to a device for controlling a movable resistance element of a training device, which element is influenced by a user with a muscular force, a use of the device, and a computer program for carrying out the method.

PRIOR ART

Research has shown that an exerciser performing a slow exercise movement mostly improves the strength for movements of similar or slower speed. In order for the exerciser to become stronger when performing movements at higher speed, it is necessary that the exerciser train using fast movements, preferably also with a lower resistance than normally. For example, studies on sprinter runners has shown that the best exercise scheme for improving running speed is to run two times downhill, one time on even ground, and one time uphill. This phenomenon is thought to depend on the nervous system controlling the muscles.

One problem when exercising is that for many training machines, in particular for weight-lifting machines, it is not possible to exercise fast movements. In a weight-lifting machine a fast movement cannot be performed because the weights in the machine would jump, which would damage the machine and/or the user. Training in an exercise machine is otherwise preferred due to the simplicity of training only one muscle or group of muscles at a time.

Another problem is that it is difficult to measure the time dependence of the muscle force for fast movements. Measuring the time dependence is important for elite athletes, but also for injured people, for example, for people injured in an accident or by prolonged repetitive work. One device for measuring the time dependence of a force is shown in the U.S. Pat. No. 6,231,481, showing an apparatus for measuring the acceleration when a person performs an exercise movement. The apparatus comprises a string, which is attached to a free weight lifted by the exerciser. When the exerciser moves the weight, the string is pulled out and the device measures position, velocity and acceleration. One problem with the device is that, since it is not possible to perform fast movements in an exercise machine, the device may only be used in connection with lifting a free weight. Thus the measurement is only reliable for skilled exercisers, who know how to perform a correct exercise movement. Furthermore, the weight used must be entered manually, meaning that the reliability of the measurement is decreased further.

Research has also shown that a more effective exercise can be obtained by varying the resistance during the exercise. One example of a device using this principle is a weight-lifting machine in which weights are added or removed at the turning points of the movement. One problem with this device is that it takes a long time to change the weights, and thus it cannot be used when training fast movements.

The U.S. Pat. No. 5,919,115, shows an exercise bike having an electric engine connected to the wheel of the exercise bike. By controlling the engine torque the resistance may be controlled. The resistance is controlled based on the rotational speed of the wheel, which is measured by sampling the wheel position at fixed time intervals. One problem with this device is that it takes time for the resistance to build up, and thus the device may not be used to exercise using fast accelerations.

The U.S. Pat. No. 4,930,770 shows a training machine comprising a grip and an electrical engine coupled to the grip via a torque coupler. The electrical engine supplies a force to the grip, which force is dependent on the position of the grip. During exercise a user applies a user force onto the grip, and the grip will move dependent on the balance between the engine force and the force applied by the user. The document also shows a force sensor arranged to measure the strength of the user, and the selection of the level of resistance depending on the strength of the user.

SUMMARY OF THE INVENTION

The present invention relates to improvements in the training for an exerciser. The present invention also relates to the measuring of the performance of an exerciser using fast movements.

According to one aspect, the invention is achieved with the method. According to another aspect the invention is achieved with a computer program. According to a third aspect the invention is achieved with a device. According to a fourth aspect the invention is achieved with the use of a device.

The invention comprises controlling a movable resistance element belonging to a training device, and the resistance element is adapted to be influenced by a user with a muscular force. The invention comprises:

- receiving a signal comprising information on the muscular force with which the user influences the resistance element,
- calculating and generating a reference signal based on the received muscular force signal and a mathematical model for the response of the resistance element, and
- controlling a power conversion device based on the reference signal, the power conversion device being coupled to and controlling the movable resistance element, so that the user experiences a desired resistance when influencing the resistance element.

By using a power conversion device, for example an electrical engine or a hydraulic cylinder, to control the movement of the resistance element, and by controlling the power conversion device based on information on the applied muscular force, the movement of the resistance element will nearly instantaneously react to the force applied by the user so that it is possible to exercise using fast movements. The response time of the control loop is also very short, which makes training with a very fast movement possible. Furthermore, since the power conversion device generates the resistance, there are no weights, which may jump and damage the training device. Thus a user using the invention may achieve a better strength improvement, and in particular a better strength improvement when using fast movements.

The invention also provides for measuring of the force, the acceleration and/or the power generated by the user during the exercise as functions of time. With the invention the measurement is both easy to make and is accurate, since a good control of the resistance level is provided by the invention. Such a measurement is very coveted within the area of athlete training and within the area of rehabilitation training, since both forms of training are made close to the physical limits of the exerciser. The muscular force may be measured directly or may be measured indirectly, for example by the use of an accelerometer and an estimation of the muscular force by considering the current resistance level. The force may also be estimated with consideration to the friction in the training device.

The resistance element may be a grip, a bar, a plate or some other form of element, which the user may influence with a muscular force. Preferably the resistance element is arranged onto a cable, which will allow free movements for the user, with improved stability training for the user, and is easy to connect to for example an electrical or other form of engine.

The reference signal comprises information on parameters for controlling the power conversion device. In a preferred embodiment the power conversion device is an electrical engine. Preferably the electrical engine is coupled to the resistance element and arranged to influence the resistance element with an engine force. Preferably said reference signal comprises parameters such as force/torque and/or engine speed. A mathematical model of the response of the resistance element may comprise a calculation routine or may comprise information of one or several parameters to be used in a calculation routine, or a combination thereof. The mathematical model may define a constant desired resistance force, or a variable resistance such that the velocity or acceleration of the resistance element is below or above a limit, or lies within an accepted interval.

In one embodiment of the invention the invention comprises sequentially receiving new values for said muscular force signal throughout the exercise, and sequentially recalculating and generating new reference signals based on the new muscular force signals. Preferably the calculation and generation of the reference signal is repeated continuously throughout the exercise, so that the device and the engine continuously control the resistance element. Hence the motion of the resistance element is dependent on the force applied by the user in each moment of the exercise.

In one embodiment the invention comprises receiving a new value for said muscular force signal within at least 30 ms, preferably 10 ms, from a previously received muscular force signal. Preferably the invention also comprises calculating and generating a new reference signal within at least 30 ms, preferably 10 ms, after a previously generated reference signal. It has been shown that a muscle may store energy during an eccentric phase and may use the stored energy in a concentric phase on the condition that the concentric phase is begun within 30 ms. Hence it is ensured that the control of the resistance element is sufficiently fast to allow the user to take advantage of any stored energy during an eccentric phase. Preferably the invention comprises continuously recalculating and generating said reference signal based on the most recently received muscular force signal in order to control the power conversion device.

According to one embodiment of the invention said muscular force is measured with a force sensor. Preferably the force sensor is a strain gauge sensor. By using a force sensor the force is measured directly, without any need to estimate the force from an acceleration measurement. Thus a more accurate force signal is obtained. By using a force sensor a better time resolution of the force may be obtained, so that the force as a function of time may be measured more accurately giving better control of the resistance and better measurements. A force sensor is also simple to arrange in a training device.

According to one embodiment said reference signal comprises information on a desired movement speed for the resistance element. In the view of the user the resistance experienced is given by the muscle force applied compared to the movement response of the resistance element. By controlling the movement speed of the resistance element a simple and effective control of the resistance is achieved, since this gives the user an illusion of that the user moves the resistance element by use of the users muscular force.

Preferably the power conversion device is powerful, so that the force generated by the power conversion device dominates the movement of the resistance element. This leads to a simpler control loop. Preferably the power conversion device is able to lift at least 200 kg, more preferably at least 300 kg. Preferably, the mathematical model comprises calculating the movement speed based on a previously, calculated desired movement speed. Thus, no velocity sensor is needed. In the case of an electrical engine as the power conversion device, said control of the electrical engine comprises generating a desired engine speed for the engine based on the reference signal, and controlling the electrical engine based on the desired engine speed, so that the resistance element receives the desired movement speed.

According to one embodiment of the invention said reference signal is calculated based on a mathematical model comprising information on at least two different resistance levels, and that the resistance element is controlled so that the user experiences a first resistance level during a first part of a movement cycle, and a second resistance level during a second part of the movement cycle. Studies have shown that a better exercise may be achieved by using a variable resistance depending on different circumstances. Preferably the invention comprises determining whether the muscle of the user is in a concentric or eccentric work phase, and controlling the resistance element, so that the user experiences a first resistance level during the concentric work phase and a second, higher resistance level during the eccentric work phase. According to research changing the resistance between eccentric and concentric muscular phases gives very good results in improving the strength of the exerciser. With the invention this change of resistance level in the middle of a movement is very simple to achieve.

According to one embodiment of the invention the mathematical model comprises a mathematical model of a weight moving in a gravitational field. Research has shown that exercises involving the lifting of weights in a gravitational field give a good improvement when compared to other forms of resistance. By using a mathematical model modeling a weight in a gravitational field, a user using the invention trains more efficiently. Furthermore the user recognizes the behavior of the resistance element from other, real, weight-lifting devices.

Preferably the gravitational field corresponds to the gravitation of the earth. In another embodiment the gravitational field may correspond to a gravitation greater than the gravitation of the earth during the eccentric phase. Hence a faster movement for the eccentric phase may be obtained.

According to one embodiment of the invention the invention comprises evaluating the condition of the muscle of the user based on the measured muscle force. In one embodiment the evaluation comprises comparing the received force signal with muscle force information stored in a diagnostic database. Preferably the evaluation is based on the muscle force as a function of time. Hence it is possible to detect injuries or other reductions in capability of the user, such as damages to muscle tissue or ligaments. In one embodiment the invention comprises changing the resistance between two exercise cycles. Thus a better evaluation may be obtained. Preferably the resistance is changed only slightly and without the knowledge of the user being measured. Hence the user cannot affect the measurement willingly, since the change in resistance is to small to be felt, but sufficient to give a changed result if the user is injured.

In one embodiment the method comprises selecting a mathematical model based on the evaluation of the condition of the muscles of the user. Thus the resistance may be changed automatically between different training sessions and/or between different repetitions of the same exercise, depending on, for example, the daily shape of the user, or the number of repetitions already performed by the user. The resistance is preferably decreased upon detection of the user becoming tired, meaning that the user may more fully exhaust himself, and with a decreased risk of injury. Preferably the evaluation of the condition of the muscle of the user is based on the muscle force as a function of time. The measurement of the muscle force as a function of time gives a good indication on the state of the muscle and of the nervous system.

According to one embodiment the invention comprises generating a feed-back signal to the user during the movement of the resistance element. The feedback signal may signal to the user that he should increase or decrease his effort if, for example, the movement speed or acceleration of the resistance element is to slow or to fast for effective and safe training. The feedback thus induces the user to perform a correct movement. The feedback signal may also provide motivation for the user.

According to one embodiment the invention comprises receiving an identity of the user, and selecting a mathematical model based on the received identity. Hence the user does not need to setup the device or input parameters himself, since the setup is carried out automatically. By using an ID it is also possible to compare the current performance with the performance of previous training sessions. The device is preferably adapted to keep track on changes in performance connected to the user ID.

According to one embodiment the invention comprises using an acceleration sensor adapted to measure the acceleration of the resistance element. The measurement value is the used to increase the accuracy of the device.

According to one embodiment of the invention the invention comprises a position sensor adapted to sense the presence of the resistance element in at least one position along the movement path of the resistance element. Preferably the position sensor is adapted to sense the presence of the resistance element in a particular point along a major portion of the movement path. Preferably a calculation member is adapted to calculate a turning point for the movement of the resistance element based on the information of the position of the resistance element. In one embodiment the mathematical model is designed so that the movement of the resistance element is turned within a certain position interval. In another embodiment the mathematical model is designed so that the resistance element is stopped from moving outside its movement path based on the measured position. The information from the position sensor may also be used for diagnostic or information purpose, and/or control purposes.

According to one embodiment of the invention the invention comprises an input member adapted to receive input from the user, and that the calculating device is adapted to calculate and generate the reference signal based on the received input. The user may thus customize the setup, in order to achieve the best individual training and results. Furthermore the user may choose a purpose with the training, for example, training to move a target weight, or training to move a weight at a target speed or acceleration.

According to one embodiment of the invention the invention comprises use of a device according to the invention in order to provide a controlled resistance when a user uses at least one muscle to influence a resistance element belonging to a training device, with a muscular force. Preferably the device according to the invention is used to measure the muscular condition of the user. Preferably the muscular condition of the user is measured at at least a first and a second resistance, which differs only slightly, so that the user cannot feel the difference. Thus the user will not be affected by mental prejudices when performing the measurement.

According to one embodiment of the invention the device according to the invention is used for improving the muscular condition of the user. By using the device according to the invention the user may become both stronger and faster in a safer way, than when training with training devices according to the prior art.

DETAILED DESCRIPTION OF PREFERRED EMBODIMENTS

Figure 1:
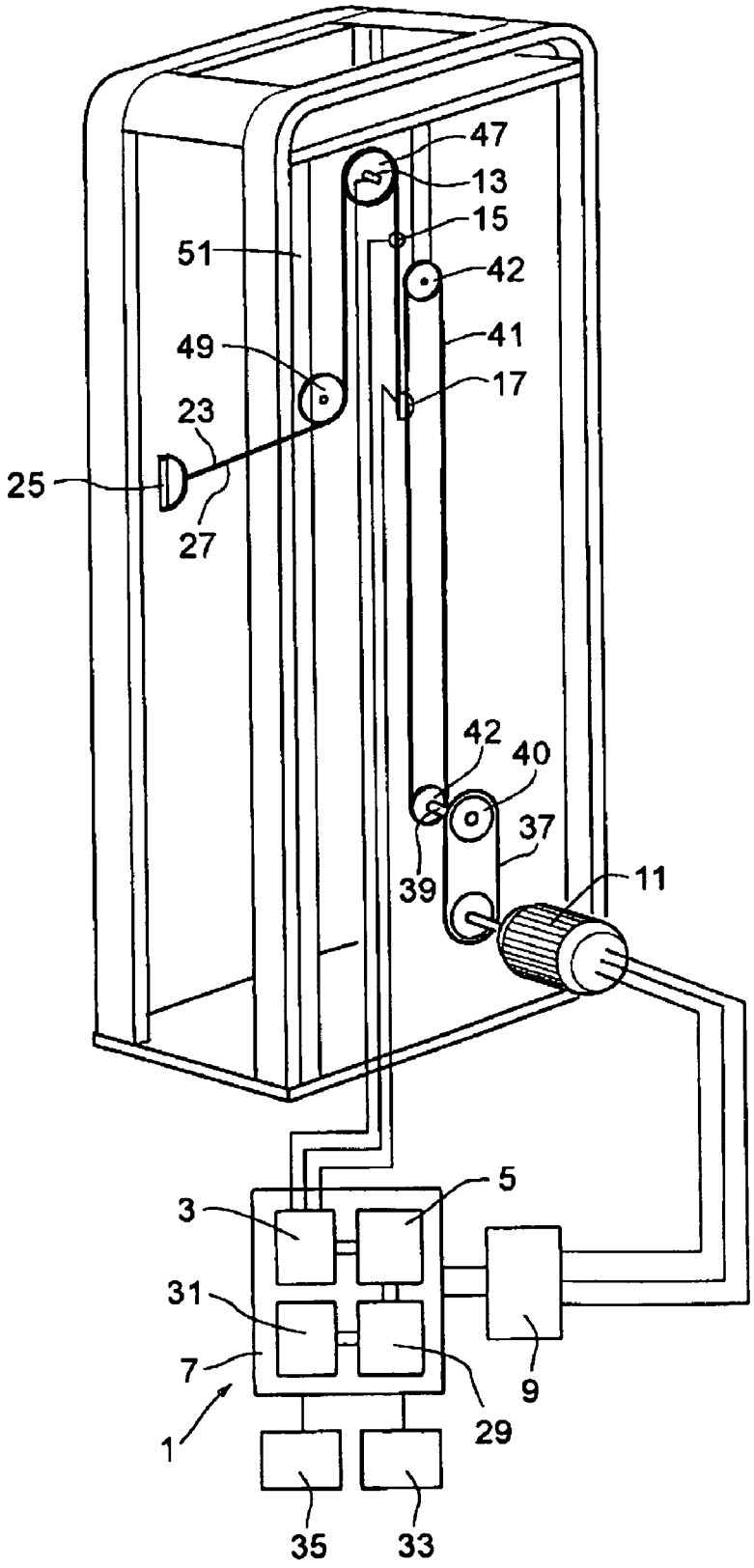
FIG. 1 shows a device according to one embodiment of the invention, which comprises a training device having a resistance element.
Figure 2:
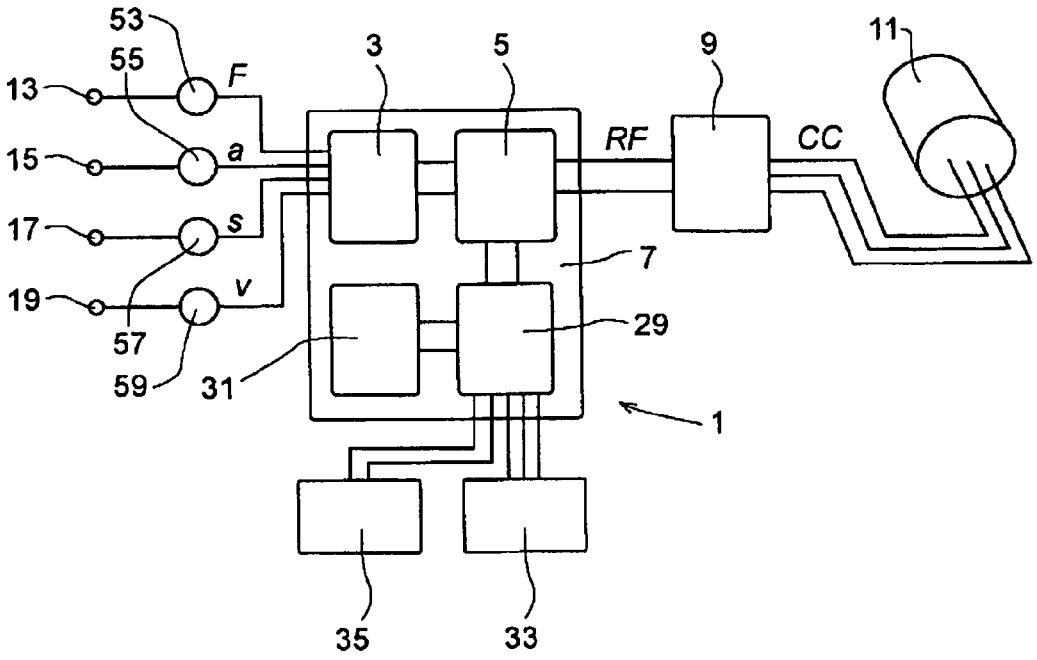
FIG. 2 shows a more detailed view of part of the device in FIG. 1, and shows in particular the signals used in the invention.

In FIGS. 1 and 2 one example of a device 1 according to the invention is shown. The device is adapted to generate a reference signal for controlling a power conversion device, in this example in the form of an electrical engine 11. The electrical engine 11 is adapted to be coupled to and to control a moveable resistance element 23 belonging to a training device 21. The movable resistance element 23 is adapted to be influenced by a user with a muscular force, when the user performs muscular exercises.

The device 1 comprises a receiving member 3 and a calculating member 5. The receiving member 3 is adapted to receive a signal comprising information on the muscular force with which the user influences the resistance element. The calculating member 5 is adapted to calculate and generate a reference signal, rf, based on the received force signal. The calculating member 5 is further adapted to calculate and generate the reference signal based on a mathematical model of a desired response of the resistance element 23.

According to one aspect of the invention the device 1 is coupled to an electrical engine 11 and a training device 21. The device 1 is adapted to control the electrical engine 11 to control the resistance element 23, so that the user experiences a desired resistance when influencing the resistance element 23. Thus it is not necessary that the device 1 comprise more elements than the receiving member 3 and the calculating member 5 in order to achieve the invention.

In this example, however, the device 1 is arranged to comprise the training device 21, and the engine 11 coupled to the resistance element 23. The device 1 further comprises an engine control member 9 adapted to receive the reference signal from the calculating member 5 and to generate at least one control current for controlling the engine 11 based on the reference signal. The electrical engine 11 is driven by the control currents to generate a torque and a rotation of an engine shaft, which are transferred to the resistance element 23. Thus the user experiences a desired resistance when influencing the resistance element 23. The user training in the training device 21 may train fast movements since the training device does not comprise real weights. It is also possible to measure the performance of the user as a function of time.

The receiving member 3 and the calculating member 5 are in this example contained in a processing member 7. The receiving member and the calculating member may be implemented in hardware or may be parts of a computer program. In another example the receiving member and calculating member may be located apart from each other.

In this example the device 1 comprises a force sensor 13 adapted to measure at least one force component influencing the resistance element. The force sensor is adapted to generate a force signal based on the measured force component. In this example the force sensor comprises a string gauge sensor arranged so that the force sensor directly measures the muscle force with which the user influences the resistance element.

The device also comprises an acceleration sensor 15 adapted to sense the acceleration of the resistance element 23. In one example the force signal may be calculated from the acceleration sensor by dividing the acceleration with the resistance. In this example the acceleration sensor 15 is used to improve the accuracy of the device 1. The device also comprises a velocity sensor 19 adapted to sense the velocity of the resistance element 23. The velocity sensor 19 also provides accuracy and feedback to the device 1. The device also comprises a position sensor 17 arranged to generate a signal comprising information on the position of the resistance element 23 along its movement path.

In this example the reference signal calculated by, the calculating member 5 comprises information on a desired movement speed for the resistance element 23. In this example the information on the desired movement speed for the resistant element comprises information on a desired engine speed for said engine. The reference signal is transmitted to the engine control member 9, which is adapted to generate control currents for the engine 11 based the received reference signal. The control currents induces the engine 11 to rotate the engine shaft and thus to control the movement speed of the resistance element 23. Thus the device 1 controls the movement speed of the resistance element 23 based on the muscular force of the user. The user thus experiences a resistance when the user influences the resistance element 23, since the user influences the resistance element 23 with a force, after which the resistance element begins to move. The user hence experiences an illusion that the muscle force of the user moves the resistance element 23 directly.

In this example the mathematical model comprises a mathematical model of a weight moving in a gravitational field. Hence the invention emulates a real weight-lifting device in which a weight is connected with a resistance element and thus the weight generates the resistance experienced by the user. The mathematical model calculates the acceleration of the resistance element based on the muscular force of the user and a virtual force from a virtual weight in a virtual gravitational field. The mathematical model also considers a virtual friction by reducing the muscle force of the user with a frictional force depending on the velocity of the resistance element 23. The mathematical model calculates the expected velocity of the resistance element 23 based on the acceleration. In this example mathematical model comprises calculating the speed of the resistance element as:

$$v_{new}=(F_{user}-F_{gravity})/m*\Delta t+v_{old}-K_{friction}$$

In the mathematical model of a weight in a gravitational field changing the parameter m determining the weight of the virtual weight also changes the resistance level. Another adjustable parameter is the frictional coefficient in the model. Yet another parameter is the gravitational field constant g present in the term: $F_{gravity}=mg$. The time $\Delta t$ corresponds to the loop time.

In another mathematical model of a weight-lifting device the model may instead model a force exerted by the virtual weight and the reference signal may comprise information on a desired engine torque.

In this example the mathematical model comprises information on at least two different resistance levels. In this example the model comprise two parameters $m_1$, $m_2$ determining the weight of the virtual weight. The device 1 is adapted to control the engine so that the user experiences a first resistance level during one part of a movement cycle of the resistance element 23, and a second resistance level during a second part of the movement cycle.

In this example the calculating member 5 is adapted to determine whether the user influences the resistance element 23 in a concentric muscular phase or in an eccentric muscular phase. The calculating member 5 is adapted to control the electrical engine, so that the user experiences a first resistance level during the concentric work phase and a second, higher resistance level during the eccentric work phase. Research has shown that an exercise may be improved by adding an additional weight during the eccentric phase of the exercise. With a device 1 according to the invention such an addition of weight is easily implemented by interchanging $m_1$ and $m_2$ for the different phases.

The calculating member 5 determines the phase by determining the movement direction of the resistance element 23 and comparing with an expected or specified exercise movement. The calculating member 5 is then adapted to change the weight parameter depending on whether the movement direction is positive or negative. The movement direction of the resistance element 23 may either be measured by the velocity sensor 19 or may be evaluated based on the generated reference signal. The muscular phase of the movement may also be determined dependent on the position of the resistance element 23, wherein the calculating model changes the movement direction of the resistance element 23 and thus the resistance level when the resistance element 23 comes close to a turning point in the movement path.

The device 1 further comprises an information processing member 29 adapted to receive information on the measured muscular force. The information processing member 29 is in this example 29 adapted to evaluate the condition of the muscle of the user based on the measured force. In this example the information processing member 29 is adapted to evaluate the condition of the muscle based on at least one of the measured muscle force as a function of time, the peak measured muscle force, the acceleration, and the velocity of the exercise movement.

The information processing member 29 is also adapted to select a mathematical model for the calculation of the reference signal based on the evaluation of the muscular condition of the user. In this example the information processing member 29 is adapted to detect a weakening of the muscular condition of the user during the exercise, meaning that the user is becoming tired. The information processing member 29 is then adapted to select a mathematical model with a lower resistance level, so that the user may continue the exercise for a longer time.

In another example of a mathematical model of a weight-lifting device or another type of training device, the resistance element is modeled to have a target acceleration or velocity interval during the exercise. In this example the calculating member 5 is adapted to calculate and generate a reference signal based on such a mathematical model, wherein the reference signal comprises information on a desired engine torque, acting on the resistance element. This is advantageous if, for example, the user is to train within a target acceleration or velocity interval, in order to improve the muscle response time, wherein the engine torque accelerate or deccelerate the resistance element to the desired interval. In this example the information processing member 29 may be adapted to select a mathematical model with a slower desired speed or acceleration interval if the user begins to tire.

The device 1 is also adapted to facilitate measurements of the user for rehabilitation purposes. The processing member 7 thus comprises a storage member 31 adapted to store measurement values from an exercise. The information processing member 29 is adapted to change the mathematical model and the resistance level, so that measurement values are obtained from different resistance levels, which increases the accuracy of a diagnosis. The storage member 31 also includes a database comprising information on reference measurement values and possible damages or injuries associated with the reference values. The information processing member 29 is adapted to access the database of the storage member 31 and to compare acquired measurement values with the measurement values in the database and thus to make a diagnosis of the condition of the user.

The device 1 also comprises an output member 33 comprising, for example, a display, or a communication line to an external device. The information processing member 29 is adapted to induce the output member 33 to display information, either automatically during an exercise or on reception of a command. The device 1 also comprises an input member 35 adapted to receive commands, and also adjustments to parameters from the user or another person monitoring the use of the device.

The output member 33 is in this example located at the training device 21. The input member 35 is located in conjunction with the output member 33. In another example the input and output members may be located remote from the training device and/or apart from each other. The processing member may also be a computer and the output and input member may be a computer screen and a keyboard.

The input member 35 is adapted to receive commands from the user on a desired mathematical model for modeling the response of the resistance element 23. An example of two different models is two models with different resistance levels in the form of different virtual weights. Preferably the input parameter may be given as a weight in kilograms or another unit. The selection of a model may also be given as a desired acceleration or velocity interval for the exercise.

The input member 35 is in this example adapted to receive an identity identifying the user. In this example the input member 35 comprises a card reading slot, wherein the user enters the identity by swiping an identity card in the slot. The information processing member 29 is adapted to receive the identity and to select a mathematical model dependent on the received identity. Thus the user does not need to set up the mathematical model himself, but a model is selected depending on previous measured values for the user. The device 1 may also be adapted to keep the resistance element 23 in a non-moving state if a correct identity is not received. Thus the input member 35 may function as a lock to the training device 21.

In the following the training device and the coupling of the engine 11 to the device will be described. The training device 21 comprises a driving gear 39, and a first transmission belt 37 arranged to transmit a force from the engine 11 to the driving gear 39. The driving gear 39 and the engine shaft are provided with wheels 40, and the transmission belt 37 is arranged around the wheels, such that power from the engine may be transferred to the driving gear 39.

The training device 21 further comprises a second transmission belt 41 arranged around a first and a second wheel 40. The first wheel 40 is connected with the driving gear 39 and the second wheel 40 is arranged on a distance from the first wheel 40, so that the second transmission belt 41 becomes extended between them.

The resistance element comprises a grip 25 and a cord 27 coupled to the second transmission belt 41. The cord 27 extends from the second transmission belt 41 to a topmost wheel 47 and further to an adjustable wheel 49 and ends with the grip 25. The height of the adjustable wheel 49 is adjustable by the user, depending on the exercise the user wishes to perform. Furthermore, the grip 25 may be replaced by another form of handle or the like, dependent on the exercise.

When the electric engine shaft rotates, the engine rotates the driving gear 39, which in turn rotates the transmission belt 41, which in turn pulls the cord or lets the cord out, and thus controls the movement of the resistance element 23 and the grip 25. In this example the movement of the resistance element is mostly linear and a movement cycle of the resistance element starts at a starting point and moves to a turning point and then moves back to the starting point again.

The training device also comprises a stand 51, which is fixed to the ground and supports the driving gear 39 and said wheels. In this example the force sensor 13 is located on a shaft supporting the topmost wheel 47. When the user influences the resistance element 23, the cord 27 influences the topmost wheel 47 and thus the shaft of the topmost wheel 47 so that the force sensor 13 gives a reading. The device also comprises a vibration dampening member, such as a rubber element or the like, arranged to dampen vibrations generated by the engine in order to improve the force measurement. The dampening member may be located in connection with the force sensor 13 or in connection with the engine 11, or both.

The acceleration sensor 15 is in this example arranged on the transmission belt 37 the position sensor 17 is located in conjunction with the transmission belt 41, and the velocity signal sensor 19 is located in conjunction with the engine 11. A man skilled in the art will readily be able to position the sensors on other locations without departing from the scope of the invention.

In FIG. 2 is shown that the device 1 also comprises a force signal transducer 53 connected with the string gauge sensor 13, and transmitting the force signal to the receiving member 3. The force signal transducer 53 also comprises a low pass filter adapted to filter the force signal from noise. The device 1 also comprises an acceleration signal transducer 55 transmitting the acceleration signal from the acceleration sensor 15 to the receiving member 3, and a position signal transducer 57 and a velocity signal 59 acting correspondingly.

In this example the device 1 is coupled to and comprises a weight lifting training device. However, the device 1 according to the invention may be coupled to any other training device of any other configuration as well, having one or several resistance elements. Further more the engine need not be a rotational electrical engine but may be a linear electrical engine depending on the preferred construction of the training device.

Figure 3A:
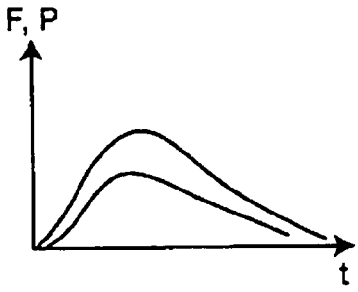
FIG. 3*a-c* show examples of measurements done by the use of the invention.
Figure 3B:
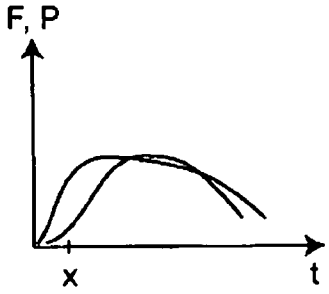
Figure 3C:
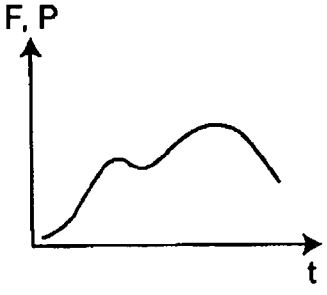

In FIG. 3*a-c* examples of measurement curves obtainable with the device 1 are shown. The diagrams in FIG. 3*a-c* show curves of the muscle force as functions of time during an exercise. Other examples of obtainable measurements comprise power, velocity, and acceleration, as functions of time, resistance level, velocity, position or the like.

In FIG. 3*a* a comparison between two force-time curves are shown, in which the topmost curve represents a force-time curve measuring a strong muscle, and the lowermost curve represents a force-time curve measuring a weak muscle. Thus the device 1 can be used to evaluate weaknesses or injuries of a user by comparing two measurements. The force-time curves may for example come from two different, but comparable, muscle groups, such as from the users left side and right side. By displaying such a comparison it is possible to measure weaknesses due to for example injuries to one side or muscle group. The force-time curves may also come from two different measuring sessions, wherein the curves may show an improvement or a deterioration of the muscle.

In FIG. 3*b* a comparison between two force-time curves are shown, in which the rightmost curve is from a muscle with slow response time, and the leftmost curve is from a muscle with a faster response time. By using the device 1, response times may thus be measured and the condition of the muscle evaluated from the measurement. It is for example possible to tell from previous measurements, for example stored in the database 35, that a user who whishes to play tennis, or perform another type of activity, must have at least a specific response time for a particular muscle group.

This minimum response time may be presented in the output member 33. In this example the mark X marks the response time needed for the user to perform an activity, such as running, playing tennis or any other physical activity. Thus for example a physiotherapist using the device 1 according to the invention for measuring the capability of a user, may easily evaluate whether the user can perform the activity. The device 1 according to the invention is thus possible to use as a measurement device 1 for determining whether a person is fit to perform an activity such as a work operation or if an athlete is sufficiently fit to enter a competition. Furthermore a physiotherapist may easily perceive in which areas the user must improve in order to improve the performance of an activity or to be able to perform an activity.

In FIG. 3*c* a force-time curve is shown having a first maximum followed by a local minimum, and a second maximum. Departing from the look of a curve like this, a physiotherapist, or the device 1, may make a diagnosis that the user has an injury, which inhibits the user from using his muscle properly. This is done since the force curve of a healthy individual should look like any of the curves in FIG. 3*a* or 3*b*. Thus the device 1 can be used to make diagnoses of users, so that the user may train in a proper way to overcome the injury as quick as possible.

Figure 4:
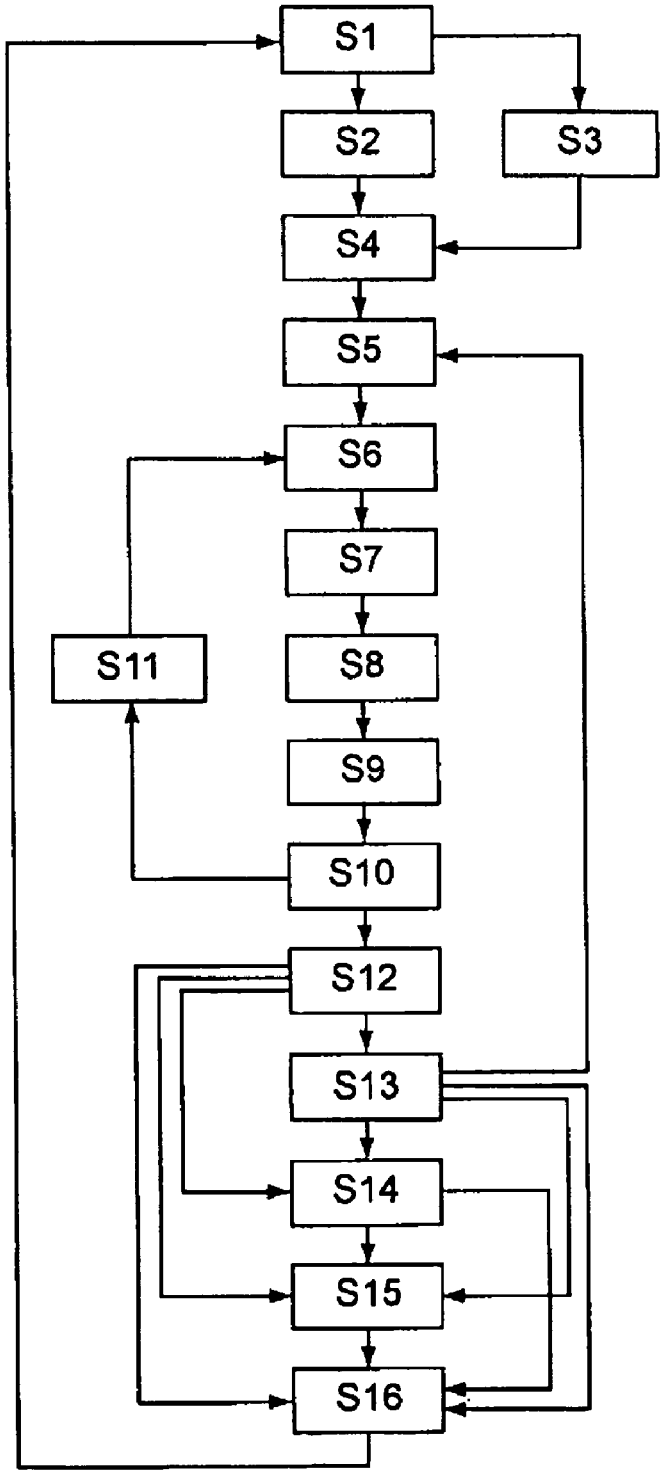
FIG. 4 shows a method according to one embodiment of the invention.

In FIG. 4 a method according to the invention is shown in block diagram form. It should be understood that the steps of the method described in conjunction with FIG. 4 could be carried out in a different order than the order shown. Furthermore, some steps may be omitted, further steps may be added, some steps may be merged with each other and some of the steps may also be performed simultaneously, without departing from the scope of the invention.

In a first step, S1, the method comprises initiating the method by the user interacting with a device according to the invention. If the user inputs a command in an input device the method moves to a step S2, if the user inputs an identity, the method moves to a step S3, and if the user interacts simply by influencing the resistance element, the method steps directly to a step S4.

In step S2 the method comprises receiving information in an input device, and furthering the information to an information processing member.

In step S3, the method comprises receiving an identity in an input device, and furthering the identity to the information processing device.

In step S4, the method comprises selecting a mathematical model based on the received command or identity. Alternatively the selected mathematical model may be a default mathematical model. The mathematical model comprises information on a desired response for the resistance element.

In step S5 the user influences the resistance element with a muscular force, meaning that the method is entering a control loop.

In a step S6, which is the first step of the control loop, the method comprises measuring said muscular force with a force sensor. The method also comprises generating a force signal comprising information about the muscular force with which the user influences the resistance element, and transmitting the force signal to a receiving member. The method also comprises storing data on the measured muscular force as a function of time in the memory.

In step S7, the method comprises receiving said force signal, and calculating and generating a reference signal for controlling an electrical engine coupled to and controlling a movable resistance element, based on the received muscular forced signal and the selected mathematical model. In this example the method also comprises transmitting the reference signal to the information processing device, and storing the reference signal in a memory. The method also comprises transmitting the reference signal to an engine control member.

In step S8, the method comprises receiving the reference signal and generating a feedback signal based on the reference signal and the selected mathematical model or a selected purpose with the exercise. The method further comprises transmitting the feedback signal to an output device, and outputting the feedback signal to the user.

In step S9, the method comprises generating a desired engine speed for the engine based on the reference signal, and controlling the electrical engine based on the reference signal and the desired engine speed, so that the resistance element receives the desired movement speed so that the user experiences a desired resistance when influencing the resistance element.

In step S10, the method comprises determining whether the resistance element 23 is influenced further by the user, by determining whether the user continues to influence the resistance element with a muscle force. If the answer is yes the method continues with the control loop by entering step S11.

If the answer in step S10 is no the method continues with a step, S12, ending the control loop.

In step S11 the method comprises determining the movement direction of the resistance element. The movement direction is determined by determining whether the movement speed is negative or positive. The determination is also based on the position of the resistance element if the resistance element is close to or past a turning point for the resistance element. The determination also comprises determining whether the user works in an eccentric phase or a concentric phase, and selecting a new mathematical model if the phase has changed. According to the method the user thus experiences a high resistance when working in an eccentric phase and a low resistance when working in a concentric phase. The method then continues with the control loop by moving to step S6. The steps S11, S6, and S7 may also be carried out simultaneously.

The control loop is repeated sequentially and continuously. In this example the control loop is restarted every 3 ms, which gives a very fast response time to changes in applied force. In an alternative embodiment the control loop may be restarted directly without determining whether the user continues to influence the resistance element in step S10. In this case the training device is therefore constantly active. Furthermore the determination of movement direction in step S11 may also be omitted in order to decrease the repeat time, and thus the response time, for the control loop.

In step S12 the control loop ends. The method then continues with step S13, S14, S15, or S15 depending on how the method was initiated and on any commands entered by the user.

In step S13 the method comprises evaluating the condition of the muscle of the user based on the stored values of the muscle force as a function of time measured during the exercise. Alternatively the method also comprises selecting a new mathematical model based on the evaluation of the condition of the muscle of the user, and storing data on the selected mathematical model in the memory. The mathematical model may also be assigned to the identity of the user. The method then continues with any of the steps S5, S14, S15 or S16.

In step S14, the method comprises presentation of the measured data and/or evaluation data to the user or to another person monitoring the exercise. The method then continues with any of the steps S15 or S16.

In step S 15, the method comprises logging out the identity from the information processing device. The method then proceeds to step S16.

In step S16, the method ends, wherein the user no longer influences the resistance element. Alternatively, if the user resumes influencing the resistance element, the method returns to step S1.

The invention is not limited to the embodiments shown, but may be varied within the framework of the following claims.

The invention claimed is:

1. A method for controlling a movable resistance element belonging to a training device when a user exercises with the training device, the resistance element being adapted to be influenced by the user with a muscular force, the method comprising:

receiving a signal comprising information on the muscular force with which the user influences the resistance element, calculating and generating a reference signal, based on the received muscular force signal and a mathematical model for the response of the resistance element, and controlling a power conversion device based on the reference signal, the power conversion device being coupled to and controlling the movable resistance element, so that the user experiences a desired resistance when influencing the resistance element.

2. The method according to claim 1, further comprising:

sequentially receiving new values for said muscular force signal throughout the exercise, and sequentially recalculating and generating new reference signals based on the new values of the muscular force signal, in order to control the power conversion device and the resistance element throughout the exercise.

3. The method according to claim 1, further comprising:

receiving a new value for said muscular force signal within at least 30 ms from a previously received muscular force signal.

4. The method according to claim 1, further comprising:

continuously recalculating and generating said reference signal based on the most recently received muscular force signal in order to control the power conversion device.

5. The method according to claim 1, further comprising:

measuring said muscular force with a force sensor.

6. The method according to claim 1, further comprising:

controlling a power conversion device comprising an electrical engine coupled to and arranged to influence the resistance element with an engine force.

7. The method according to claim 1 wherein said reference signal comprises information on a desired movement speed for the resistance element.

8. The method according to claim 1, wherein said reference signal is calculated based on a mathematical model comprising information on at least two different resistance levels, and wherein the power conversion device is controlled so that the user experiences a first resistance level during a first part of a movement cycle, and a second resistance level during a second part of the movement cycle.

9. The method according to claim 8, further comprising:

determining whether the muscle of the user is in a concentric or eccentric work phase, and controlling the power conversion device, so that the user experiences a first resistance level during the concentric work phase and a second, higher resistance level during the eccentric work phase.

10. The method according to claim 1 wherein the mathematical model comprises a mathematical model of a weight moving in a gravitational field.

11. The method according to claim 1, further comprising:

evaluating the condition of the muscle of the user based on the received muscle force signal by comparing the muscle force signal with muscle force information stored in a diagnostic data base.

12. The method according to claim 1, further comprising:

generating a feed-back signal to the user during the movement of the resistance element.

13. The method according to claim 1, further comprising:

receiving an identity of the user, and selecting a mathematical model based on the received identity.

* * * * *